US011085284B2

(12) United States Patent
Cardona

(10) Patent No.: US 11,085,284 B2
(45) Date of Patent: Aug. 10, 2021

(54) VERTICAL DRILLING SYSTEM OF AUGER TYPE PROVIDED WITH A TRAJECTORY CORRECTING DEVICE

(71) Applicant: SOLETANCHE FREYSSINET, Rueil Malmaison (FR)

(72) Inventor: Gérard Cardona, Rueil Malmaison (FR)

(73) Assignee: SOLETANCHE FREYSSINET, Paris (FR)

( * ) Notice: Subject to any disclaimer, the term of this patent is extended or adjusted under 35 U.S.C. 154(b) by 0 days.

(21) Appl. No.: 16/626,363

(22) PCT Filed: Jun. 18, 2018

(86) PCT No.: PCT/EP2018/066108
§ 371 (c)(1),
(2) Date: Dec. 24, 2019

(87) PCT Pub. No.: WO2019/002002
PCT Pub. Date: Jan. 3, 2019

(65) Prior Publication Data

US 2020/0116006 A1 Apr. 16, 2020

(30) Foreign Application Priority Data

Jun. 30, 2017 (FR) ..... 1756218

(51) Int. Cl.
*E21B 44/00* (2006.01)
*E02D 5/46* (2006.01)
(Continued)

(52) U.S. Cl.
CPC ..... *E21B 44/00* (2013.01); *E02D 5/46* (2013.01); *E02D 27/12* (2013.01); *E21B 7/10* (2013.01);
(Continued)

(58) Field of Classification Search
CPC . E21B 44/00; E21B 7/10; E21B 7/022; E21B 7/064; E21B 10/44; E21B 47/024;
(Continued)

(56) References Cited

U.S. PATENT DOCUMENTS 6,978,849 B2 * 12/2005 Sherwood ..... E02D 5/36 175/19
2007/0114068 A1 5/2007 Hall
(Continued)

FOREIGN PATENT DOCUMENTS

| | | |
|---|---|---|
| DE | 8511302 U1 | 7/1986 |
| FR | 2566813 A1 | 1/1986 |
| FR | 2831205 A4 | 4/2003 |

OTHER PUBLICATIONS

English language abstract of DE 8511302 U1.
English language abstract of FR 2566813.

*Primary Examiner* — Giovanna Wright
*Assistant Examiner* — Yanick A Akaragwe
(74) *Attorney, Agent, or Firm* — Workman Nydegger

(57) ABSTRACT

The disclosure relates to a system for drilling a vertical well in soil according to a substantially vertical theoretical drilling trajectory comprising a drilling device including a hollow core having a longitudinal axis, the hollow core being provided with a drilling tool; a rotating driving device exhibiting an active state in which the driving device is oriented with respect to the soil in an angular correction position, and a passive state in which the driving device does not modify the displacement trajectory of the drilling device;

a device for measuring the deviation of the hollow core;

a control device configured to make the driving device swivel when a deviation is measured, in order to bring it in its active state in an angular correction position (Continued)

determined such that, considered in the horizontal plane, the trajectory correcting direction associated with the angular correction position is opposite to the deviation direction.

21 Claims, 6 Drawing Sheets

(51) Int. Cl.

| | |
|---|---|
| ***E02D 27/12*** | (2006.01) |
| ***E21B 7/10*** | (2006.01) |
| ***E21B 10/44*** | (2006.01) |
| ***E21B 47/024*** | (2006.01) |
| *E21B 7/02* | (2006.01) |

(52) U.S. Cl.
CPC ..... *E21B 10/44* (2013.01); *E21B 47/024* (2013.01); *E02D 2250/003* (2013.01); *E02D 2250/0023* (2013.01); *E02D 2250/0038* (2013.01); *E02D 2600/10* (2013.01); *E21B 7/022* (2013.01)

(58) Field of Classification Search
CPC .. E02D 5/46; E02D 5/44; E02D 27/12; E02D 2250/0023; E02D 2250/003; E02D 2250/0038; E02D 2600/10
See application file for complete search history.

(56) References Cited

U.S. PATENT DOCUMENTS

| | | | |
|---|---|---|---|
| 2012/0031677 | A1 | 2/2012 | Schulte |
| 2012/0080234 | A1 | 4/2012 | Hall |

* cited by examiner

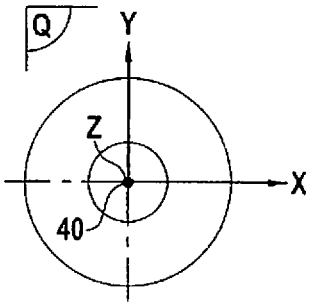
FIG.5B
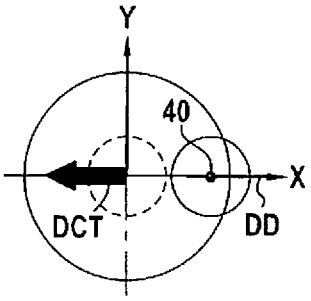
FIG.6B
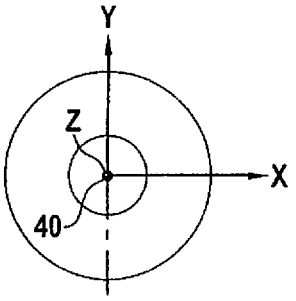
FIG.7B
FIG.5A
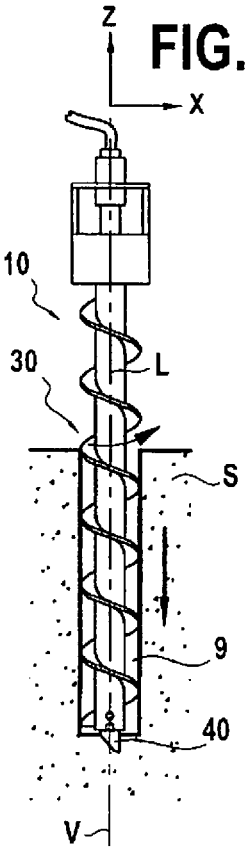
FIG.6A
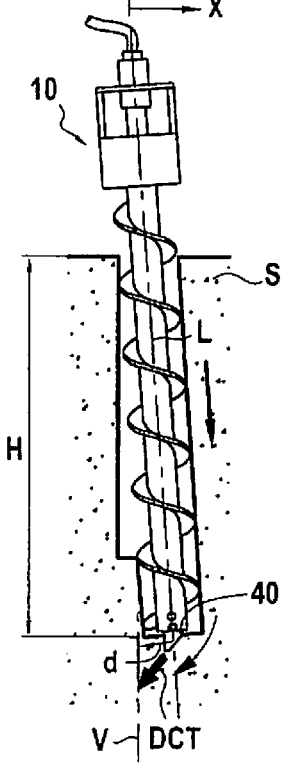
FIG.7A
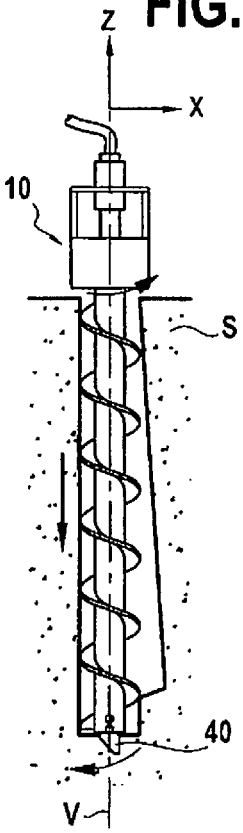
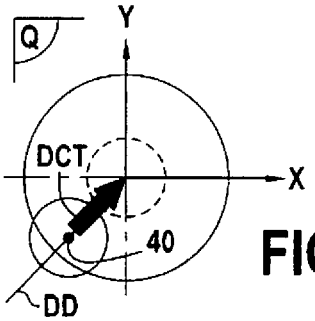
FIG.8

VERTICAL DRILLING SYSTEM OF AUGER TYPE PROVIDED WITH A TRAJECTORY CORRECTING DEVICE

BACKGROUND

The present invention relates to the field of producing deep foundations in a soil and in particular the field of shoring by columns, such as piles. It also relates to making low course foundation piles, the producing of sealing shields made using secant piles, and more generally the producing of all types of walls in secant or joined piles, whatever the function of said wall.

Shoring by columns or piles means all types of shoring for which piles are installed in the soil: Parisian wall, Berlin wall, secant pile wall, contiguous pile wall, etc.

The piles are generally constituted of concrete or a thin cement mix. They can also be obtained by a technique of mixing the soil and a binder, generally called "soil-mixing".

The piles can be reinforced, for example thanks to the use of a concrete reinforcing cage, a pipe or a metal profile.

In order to achieve such piles, it is known to use a drilling device called continuous auger. The drilling device includes a hollow core including a drilling tool constituted of a helical blade. With this type of drilling device, drilling the well is achieved in one single descent of the auger down to the required depth. In order to make the column, the thin cement mix or the concrete is injected from the lower end of the auger during the lifting of the auger.

For retaining structures, it is important to ensure the position of the piles whatever their depth in order to ensure the geometry of the spaces achieved in the sub-soil.

Likewise, for foundation piles whereof the higher level is located at a certain depth of the working platform, the real position of the pile at this depth should be guaranteed.

However, during a drilling carried out by means of a continuous auger, the drilling trajectory is often ill-mastered in such a way that sometimes significant deviations can be observed with respect to the generally vertical theoretical drilling trajectory.

By deviation, is usually meant the distance between the real position of the auger with respect to its theoretical position, at a given depth. It is usually defined as the distance between the real position and the theoretical position divided by the depth and expressed in percentage, the distance being generally considered in a horizontal plane.

Some continuous augers exhibit deviations that can reach 5% whereas deviation tolerances for retaining structures are usually lower than 0.5%.

SUMMARY

A purpose of the present disclosure is to propose a system for drilling a well in a soil allowing to reduce the deviation risk with respect to the theoretical trajectory.

To do this, the disclosure relates to a system for drilling a well in a soil according to a substantially vertical theoretical drilling trajectory, wherein the system includes:

- a drilling device including a hollow core having a longitudinal axis, the hollow core being provided with a drilling tool;
- a first device for setting into rotation to put in rotation, around a longitudinal axis, the hollow core and the drilling tool;
- a linking element extending inside the hollow core; the linking element including a tremie pipe which presents a lower part provided with at least an injecting hole, the tremie pipe being connected to a fluid supply source;
- a driving device disposed at the lower end of the tremie pipe; the driving device presenting:
- an active state in which the driving device is oriented and maintained with respect to the soil in an angular correction position, in such a way as to correct the displacement trajectory of the drilling device according to a trajectory correcting direction considered in a horizontal plane, and
- a passive state in which the driving device does not modify the displacement trajectory of the drilling device;
- a hollow core deviation measuring device for identifying a possible deviation between the displacement trajectory of the drilling device and the theoretical drilling trajectory and determining a deviation direction of the drilling device with respect to the theoretical drilling trajectory, said deviation direction being considered in the horizontal plane;
- a control device configured for, when a deviation is measured, bringing the driving device in its active state in an angular correction position determined in such a way that, considered in the horizontal plane, the trajectory correcting direction associated with the angular correction position is opposite to the deviation direction.

According to the meaning of the invention, by setting into rotation, is meant the fact of turning or pivoting the linking element around the longitudinal axis over one or several turns, or even on a fraction of a turn, in one direction or the other.

By column, is meant any retaining element, and in particular a molded pile.

By substantially vertical, is meant a drilling direction of which the deviation with respect to the vertical is between 0° and 5°, preferably between 0° and 1°.

According to the meaning of the disclosure, the theoretical drilling trajectory can be predetermined prior to the drilling operation, or determined during drilling with respect to the geometry or the orientation of a neighbouring column constructed beforehand in the soil in order to obtain two juxtaposed and secant columns according to their joint length.

It is understood that the driving device, in particular in its passive state, can rotate with respect to the hollow core, in the same direction or in an opposite direction. Without departing from the scope of the present disclosure, in its passive state, the driving device can also be locked in rotation with respect to the hollow core.

It is also understood that the driving device, at least in its active state, extends axially outside the hollow core, beyond the lower end thereof.

When a deviation in the displacement trajectory with respect to the theoretical drilling trajectory is detected by the deviation measuring device, the driving device is brought in its active state in order to correct the trajectory of the drilling device. To do this, the driving device is oriented and maintained with respect to the soil in the angular correction position, the latter being determined in such a way that the driving device modifies the trajectory of the hollow core during the advance of the drilling device, in order to reduce the deviation with respect to the theoretical drilling trajectory. By "maintaining in the angular correction position" is meant angular maintaining of more or less 10°, preferably 5°, around said position.

Preferably, maintaining the driving device with respect to the soil is made by locking into rotation the driving device with respect to the soil in the angular correction position.

The modification of the displacement trajectory of the hollow core is obtained by the fact that the driving device during its displacement in the soil in its active state, tends to move according to a slanted direction with respect to the longitudinal axis of the hollow core, thus resulting in making it swivel in a vertical plane.

According to an advantageous embodiment, the drilling system further includes a second device for setting into rotation, connected to the linking element, to set in rotation the linking element and the driving device around the longitudinal axis, the linking element is capable of rotating with respect to the hollow core, and the control device is configured to actuate the second device for setting into rotation when a deviation is measured so as to bring the driving device in its active state into said angular correction position.

In this embodiment, the orientation of the driving device in its angular correction position is hence, carried out by the second device for setting into rotation which makes the linking element swivel with respect to the soil. The locking in rotation of the driving device with respect to the soil is preferably carried out by the second device for setting into rotation.

Once the trajectory has been corrected, the driving device is brought in its passive state.

By "opposite to the deviation direction", is meant that the trajectory correcting direction is directed in an opposite direction to the deviation direction, without the correction direction necessarily being parallel to the deviation direction.

Advantageously, the control device further includes a computing device for computing the angular correction position based on the deviation direction determined by the measuring device.

Preferably, said horizontal plane wherein the deviation direction extends, presents a point of reference provided with at least one axis, and the angular position of the driving device is determined based on an angle between said axis of the point of reference and the deviation direction.

According to a first embodiment example, the driving device is configured to rotate in the same direction and at the same speed as the hollow core, when said driving device is in the passive state.

In order to do this, the drilling device preferably includes a coupling device to lock the rotation of the driving device with respect to the hollow core when said driving device is in the passive state.

This coupling device includes for example a pawl link.

According to a second embodiment example, the second device for setting into rotation is configured to make the driving device rotate in the opposite direction to the rotation direction of the hollow core, when said driving device is in the passive state.

The rotation of the hollow core and the driving device in the opposite direction causes to modify the displacement trajectory of the drilling device.

According to another embodiment, the driving device is also moveable in translation with respect to the hollow core, the drilling system further including a displacement device for displacing the driving device in translation with respect to the hollow core according to the longitudinal axis, in such a way that the driving device presents a deployed position and a retracted position.

In this other embodiment, the drilling system can include, or not, the second aforementioned device for setting into rotation. In the alternative in which the second device for setting into rotation is absent, it can be provided declutchable coupling means of pawl type in order to couple the hollow core and the driving device in rotation. In this case, the driving device is brought in the angular correction position by actuating the first device for setting into rotation, the driving device thus being coupled in rotation with the hollow core. To correct the trajectory, the driving device is brought in deployed position after having deactivated the coupling means, then the hollow core is made to advance by driving it into rotation thanks to the first setting into rotation device, until the driving device is brought to retracted position. In this case, the driving device is maintained in its angular correction position, during the deployment, by the displacement device.

When the second setting into rotation device is present, the driving device is locked in rotation—during the deployment of the driving device—thanks to the second setting into rotation device.

Preferably, in retracted position, the driving device extends slightly beyond the lower end of the hollow core. Alternatively, the driving device can be entirely housed in the hollow core.

Advantageously, the displacement device is configured to displace the driving device in translation with respect to the hollow core by jacking, jarring or vibratory driving.

Preferably, in its active state, the driving device is in deployed position, whereas, in its passive state, the driving device is in retracted position.

According to the disclosure, the linking element includes a tremie pipe which presents a lower part provided with at least one injecting hole, the tremie pipe being connected to a fluid supply source.

Such a tremie pipe is in particular described in FR 2566813 and FR2831205. It allows injecting fluid into the well during the ascent of the drilling device, in order to make a column.

Preferably, the injecting hole is disposed over the lower end of the hollow core when the driving device is in deployed position. This injecting hole is hence also disposed over the lower end of the hollow core when the driving device is in retracted position. The driving device further includes an injecting position wherein the injecting hole is found underneath the lower end of the hollow core.

The tremie pipe is preferably brought to injecting position thanks to the displacement device which displaces the driving device downwards in translation to uncover the injecting hole.

Advantageously, the measuring device includes a deviation sensor disposed in the lower part of the hollow core.

The deviation sensor allows to measure a deviation distance, considered in a horizontal plane, between the real position of the lower end of the hollow core and the generally vertical theoretical drilling trajectory.

Advantageously, the drilling system further includes a member for measuring the depth reached by the drilling device, the measuring device is configured to measure a deviation angle of the hollow core with respect to a vertical direction, and the control device is configured to bring the driving device in its active state—for example by actuating the second device for setting into rotation—when the ratio of the deviation distance to the depth reached by the drilling device is higher than or equal to a predetermined threshold, this threshold depending on the depth.

Furthermore, without departing from the scope of the present disclosure, the control device could be configured to only operate from a certain depth, for example 3m.

By way of example, if the well has a required depth of 20 m, the control device could be configured to be actuated starting from 3 m in the case where a distance of deviation higher than 2 cm is detected. Then, starting from a drilling depth of 15 m, the control device can be figured to be actuated in the case where a deviation distance higher than 3 cm is detected.

Thus, the deviation correction of the drilling device is carried out automatically and continuously during the drilling operation.

Advantageously, the drilling is carried out continuously, with an alternation of moments during which the drilling device is displaced with a trajectory deemed satisfactory, and moments during which the driving device is locked in rotation in a defined angular position when the trajectory should be corrected on the grounds that the deviation is higher than a predetermined threshold.

Advantageously, the drilling device is an auger, for example an auger such as described in FR2566813 or FR2831205, or any other type of continuous auger.

Advantageously, the driving device includes a slanted section with respect to a vertical plane, and the trajectory correcting direction is the direction corresponding to the intersection between the slanted section and a vertical plane orthogonal to the slanted section.

The slanted section hence acts like a sort of front rudder, in order to modify the displacement trajectory of the hollow core during the penetration of the drilling device into the soil.

The disclosure also relates to a method for drilling a well in a soil according to a theoretical drilling trajectory, wherein:

It is provided a drilling system according to any one of the preceding claims;

the drilling device is introduced in the soil while setting the hollow core into rotation, the driving device being in its passive state;

the deviation of the hollow core is measured in order to determine a deviation direction of the drilling device with respect to the theoretical drilling trajectory;

when a deviation higher than a predetermined threshold is measured, the driving device is brought in its active state by orienting it and maintaining it with respect to the soil in an angular correction position, determined such that, considered in a horizontal plane, the trajectory correcting direction associated with the angular correction position is opposite the deviation direction.

The introduction of the drilling device into the soil is pursued and the driving device, in its active state, has for effect to make the hollow core swivel such as to make it return to the theoretical drilling trajectory.

If the measured deviation becomes lower than the predetermined threshold, the driving device is brought back to its passive state.

Advantageously, when a deviation is measured:

the driving device is brought in its active state by orienting and maintaining the driving device in an angular correction position determined with respect to the soil, such that, considered in a horizontal plane, the trajectory correcting direction associated with the angular correction position is opposite the deviation direction;

the driving device is brought in its deployed position;

the hollow core is displaced with respect to the soil such that the displacement of the hollow core follows the displacement of the driving device.

The displacement in translation of the driving device in the soil results in modifying the inclination of the linking element and the hollow core. When the hollow core has caught up with the driving device, the latter then found in retracted position, the displacement trajectory of the hollow core is corrected.

Here still, when the measured deviation is lower than the predetermined threshold, the driving device is brought in its passive state and in retracted position.

BRIEF DESCRIPTION OF THE DRAWINGS

The disclosure will be better understood upon reading the following description of the embodiments of the disclosure given by way of non limiting examples, with reference to the accompanying drawings, on which:

FIG. 5A illustrates the drilling system according to a first embodiment of the disclosure, during drilling, the trajectory not being deviated;

FIG. 5B is a projection in the horizontal plane XY of the lower end of the drilling device of FIG. 5A;

FIG. 6A illustrates the drilling system of FIG. 5A, the drilling device having deviated with respect to the vertical theoretical trajectory, the driving device being in its active state in order to correct the deviation;

FIG. 6B is a projection in the horizontal plane XY of the lower end of the drilling device of FIG. 6A;

FIG. 7A illustrates the drilling system of FIG. 6A after correction of the trajectory;

FIG. 7B is a projection in the horizontal plane XY of the lower end of the drilling device of FIG. 7A;

FIG. 8 illustrates a projection in the horizontal plane XY of the lower end of the drilling device when the latter has undergone a deviation according to the axes X and Y;

DETAILED DESCRIPTION

Figure 1:
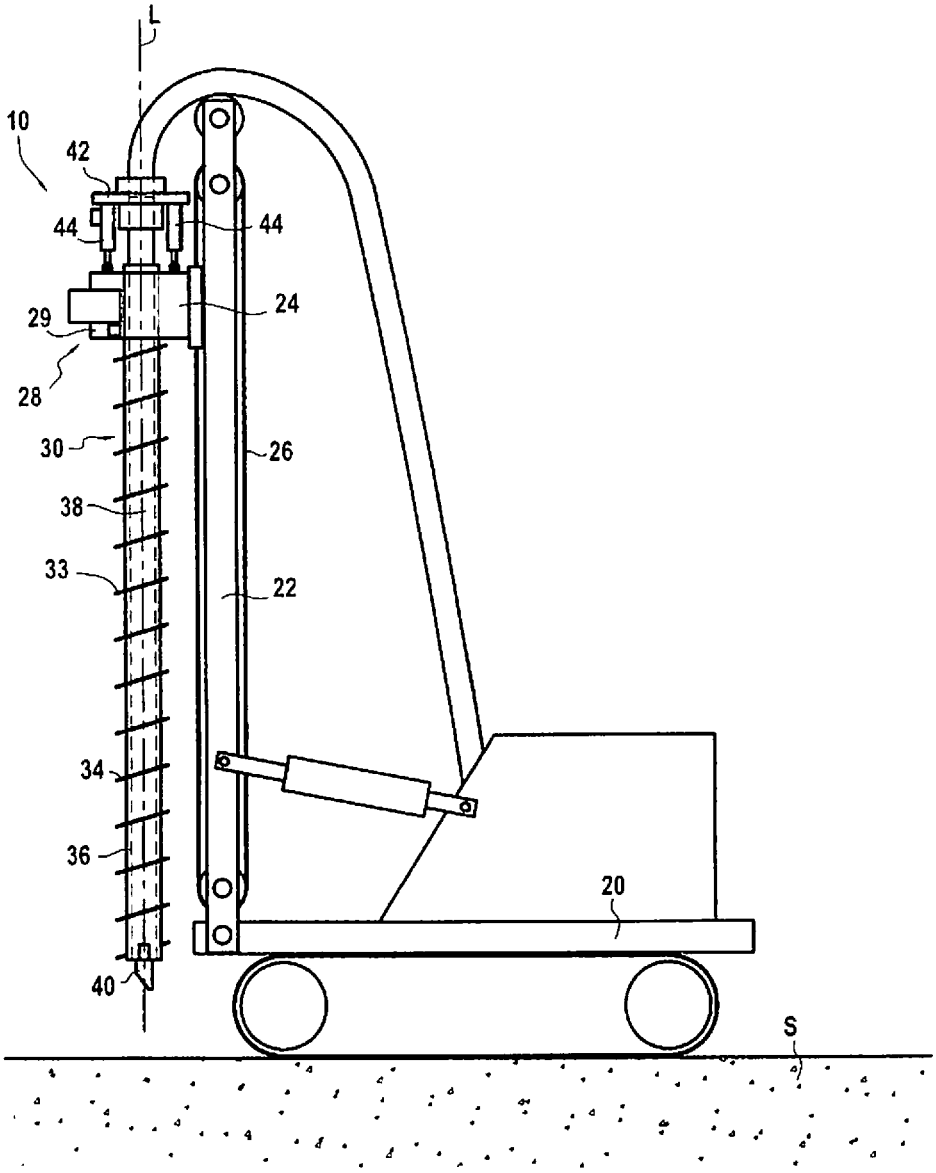
FIG. 1 is an overall view of a drilling system according to the present disclosure.
Figure 2:
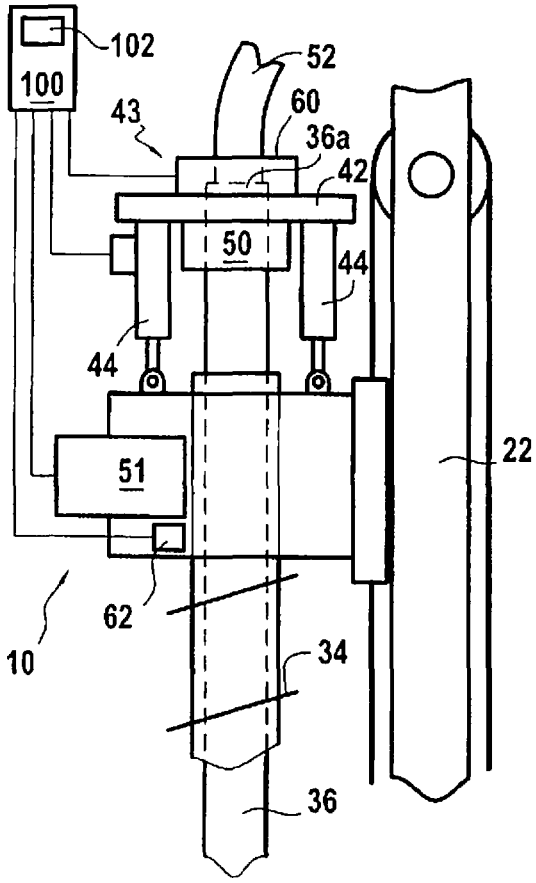
FIG. 2 is a detailed view of the upper part of the drilling system of FIG. 1.

In reference first to FIGS. 1 and 2, it shall be described a system 10 for drilling a well 9 in a soil S, in accordance with the present disclosure, for making columns, such as molded piles.

The drilling system comprises a platform 20 on which is mounted a guiding mast 22 that is substantially vertical in usage position. On this mast is moveably mounted in vertical translation a cart 24 that can be displaced by means of cables 26 associated with a motor that is not represented. The cart 24 bears a first device for setting into rotation 28 comprising a drilling head 29 allowing the setting into rotation of a drilling device 30 including a hollow core 32 provided with a drilling tool 33, in this instance a helical blade extending substantially over the entire length of the hollow core 32. In this example, the drilling device 30 is hence a vertical auger with a hollow core.

It is worth noting that the hollow core 32 extends according to a longitudinal axis L that is substantially vertical.

Inside the hollow core 32 of the drilling device is freely mounted a linking element 36 that is capable of turning with respect to the hollow core around the longitudinal axis L.

In this example, the linking element 36 has the form of a hollow pipe whereof the lower end is equipped with a driving device 40, that shall be described in further detail after.

A moveable plate 42 is connected to the drilling head 29 by means of vertical jacks 44. This plate 42, as illustrated on FIG. 2, receives the upper end 36*a* of the lining element 36.

In this embodiment, the drilling system further includes a second device for setting into rotation 50, that is connected to the linking element 36, to set into rotation the linking element 36 and the driving device 40 around the longitudinal axis L.

In this example, the linking element is a tremie pipe whereof the upper end is connected to a flexible duct 52 for supplying the pipe with concrete or a thin cement mix.

As is shown on FIG. 2, the first device for setting into rotation 28 includes an engine 51 for setting into rotation the hollow core 32. Furthermore, a turning seal 60 ensures the link through the plate 42 between the upper end of the linking element 36 and the flexible duct 52. It is understood that the jacks 44 allow modifying the axial position of the linking element 36 with respect to the hollow core 32. Furthermore, the cable 26 for the vertical displacement of the drilling head 29 or its drive engine is associated to a linear displacement sensor 62 which allows measuring the vertical displacement of the drilling device. This displacement sensor constitutes a device for measuring the depth H reached by the drilling device.

Figure 3:
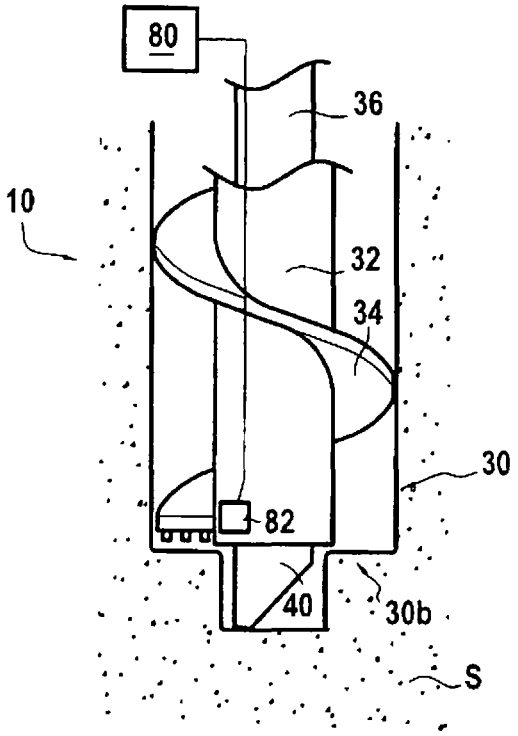
FIG. 3 is a detailed view showing the lower part of the drilling device and the driving device according to a first embodiment of the disclosure.

FIG. 3 illustrates the lower end 30*b* of the drilling system 30 according to a first embodiment of the disclosure.

In the current phase of drilling the well 9, the linking element 36 and the hollow core 32 can be secured in rotation, for example by a pawl system, such that the driving device 40 and the drilling device 30 rotate together in the same direction, without any relative rotational movement between the linking element 36 and the hollow core 32. According to another alternative, illustrated on FIG. 3, the driving device 40 can be set into rotation, by the second device for setting into rotation 50, according to a rotation direction opposite to the rotation direction of the hollow core 32. As it shall be explained in further detail here-below, the second device for setting into rotation 50 is also capable of locking the rotation of the linking element 36 with respect to the soil S.

Figure 4A:
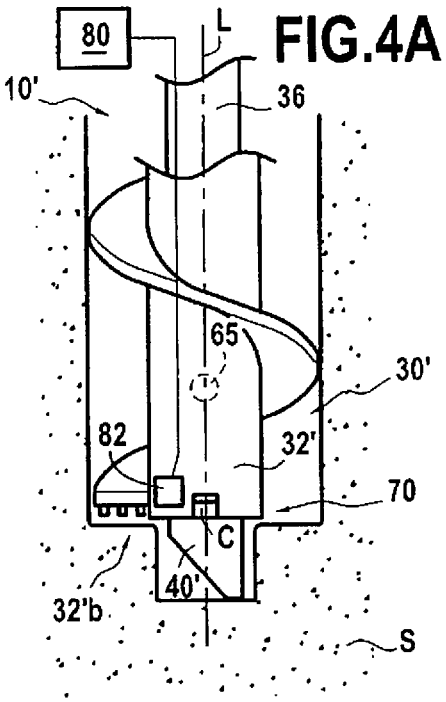
FIG. 4A is a detailed view showing the lower part of the drilling device and the driving device according to a second embodiment of the disclosure, the driving device being in retracted position.
Figure 4B:
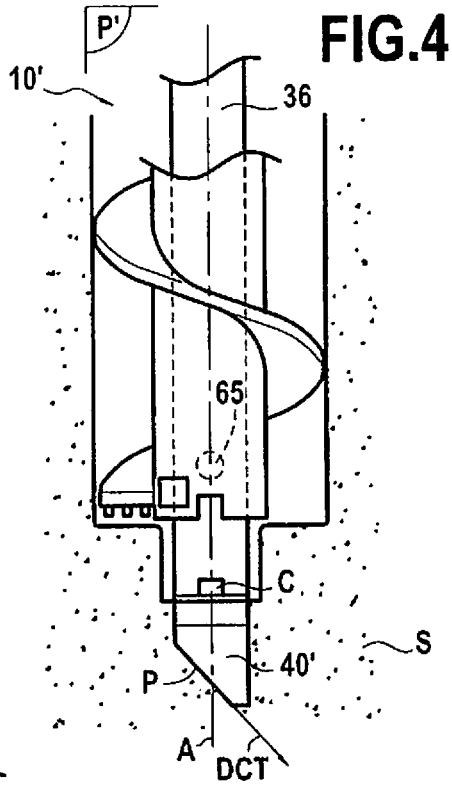
FIG. 4B is a detailed view of the drilling device of FIG. 4A, the driving device being in deployed position.

On FIGS. 4A and 4B, it has been illustrated a second embodiment of the drilling system according to the disclosure. This second embodiment differs from the first by the fact that the drilling device 30' includes a coupling device 70, in this example a pawl, to lock the driving device 40' in rotation with respect to the hollow core 32'. It is also worth noting that the driving device 40' is moveable in translation with respect to the hollow core 32' according to the longitudinal axis L. The drilling system 10', the jacks 44 and the plate 42 constitute a displacement device 43 for displacing in translation the driving device 40' with respect to the hollow core 32' according to the longitudinal axis L, such that the driving device 40' presents a deployed position, illustrated on FIG. 4B, and a retracted position illustrated on FIG. 4A.

Also, when the jacks 44 are in deployed position, the driving device 40' is in retracted position, whereas the jacks 44 are in on-board position, the driving device 40' is in deployed position.

The displacement device 43 is furthermore configured for displacing the driving device 40' with respect to the driving device 32' by jacking, jarring or vibratory driving.

In order to do this, the displacement device 43 could also be equipped with a vibrating head, not illustrated here.

Figure 4C:
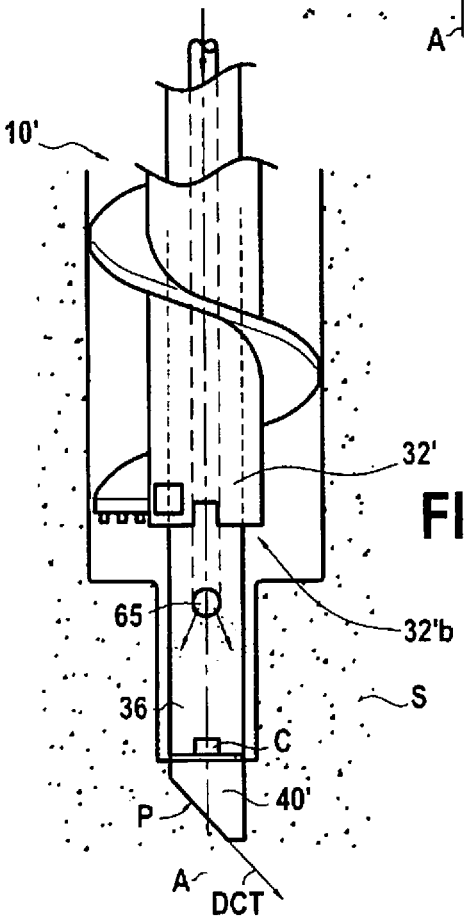
FIG. 4C illustrates the tremie pipe in injecting position.
Figure 9:
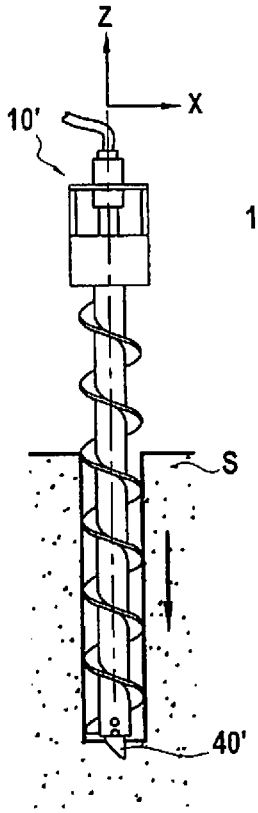
FIGS. 9 to 12 illustrate a drilling method implemented by the drilling system according to the second embodiment, illustrating a trajectory correction after detecting a deviation.
Figure 10:
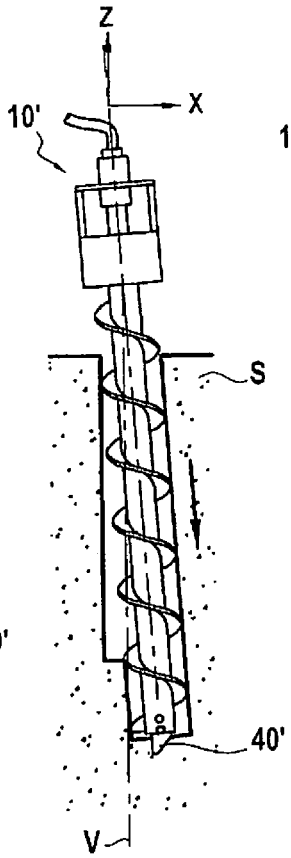

In this example, the linking element comprises a tremie pipe, which is provided in its lower part, with injecting holes 65 which are concealed by the hollow core 32' when the driving device 40' is in retracted position. Preferably, the injecting holes 65 are also concealed by the hollow core when the driving device is in deployed position. In this case, the driving device can also present an injecting or concreting position, illustrated on FIG. 4C, wherein the driving device is deployed even further in such a way that the injecting holes are uncovered so as to allow concreting. In order to do this, the driving device is displaced downwards in translation thanks to the displacement device 43, such that the injecting hole 65 is found underneath the lower end 32'*b* of the hollow core 32'. In this position, the concrete is injected into the borehole, for example during the ascent of the drilling device 30.

For a more precise explanation about the utility of the injecting holes 65, one may refer to document FR2831205 which describes in detail the method for making a pile using a continuous auger.

Figure 16:
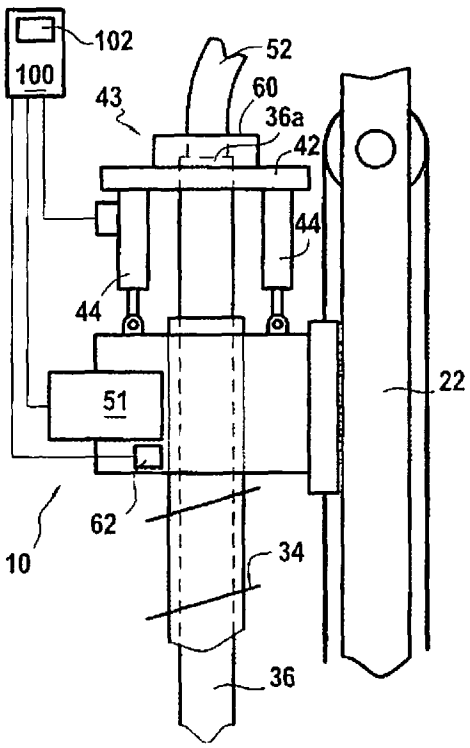
FIG. 16 is an alternative embodiment of the drilling system of FIG. 2 without the second device for setting into rotation.
Figure 15:
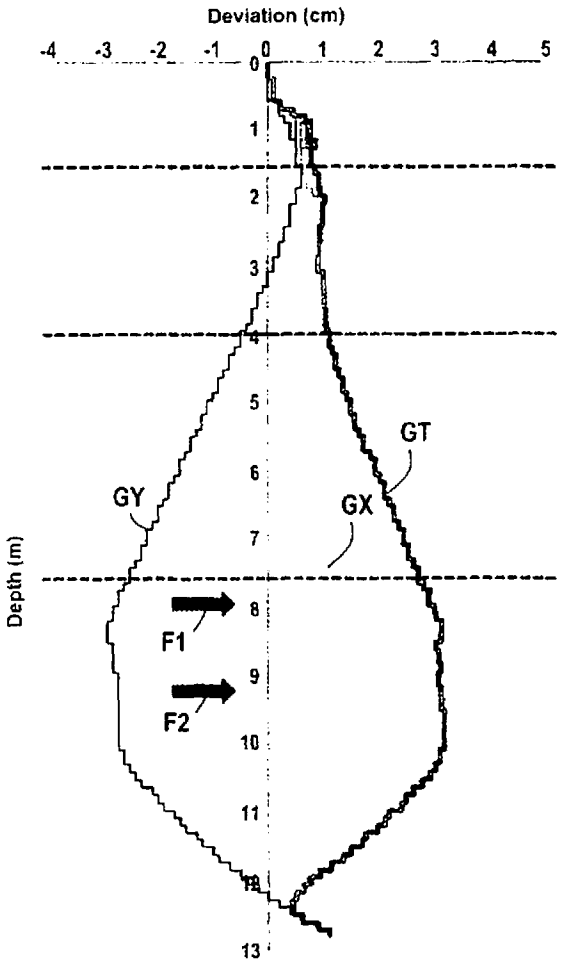
FIG. 15 is a diagram illustrating the real trajectory of the drilling system of FIG. 1 during a drilling operation.

On FIG. 16, it has been illustrated an alternative of the second embodiment, wherein the drilling system is devoid of the second device for setting into rotation. In this case, the setting into rotation of the driving device is achieved by the first device for setting into rotation 51 after the linking element is coupled in rotation with the hollow core by the coupling device 70.

In the present disclosure, the focus is mainly on monitoring the drilling trajectory of the drilling device.

Figure 13:
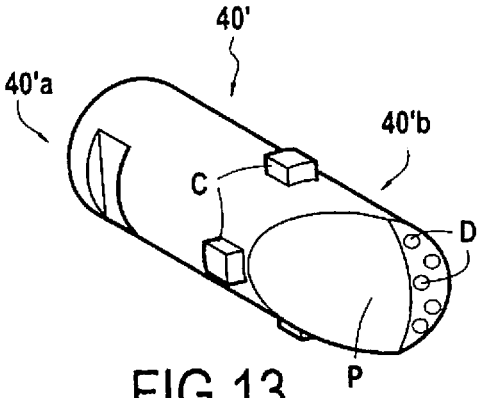
FIG. 13 is a perspective view of a driving device of the drilling system according to the disclosure.

By means of FIGS. 13 and 14, it will now be described in a more detailed manner the driving device 40' of the drilling system 10' according to the second embodiment of the present disclosure.

The driving device 40' presents a cylindrical form comprising a first end 40' provided with a portion for securing to the linking element 36, and a second end part 40'*b*, opposite to the first end part 40'. The second end part 40'*b* comprises a front face provided with cutting teeth D that form bulges. The driving device 40' furthermore includes a section P that is slanted with respect to a plane passing by the axis A of the driving device 40'. The inclination angle between the section P and the axis A of the driving device 40' is referenced a on FIG. 14. The driving device 40' further includes protruding squares C that are part of the pawl system 70 described here-above. In this embodiment, the angle $\alpha$ has a value preferably ranging between 15° and 25°.

The function of this specific form of driving device 40' shall be explained here-below.

It is worth noting that the driving device 40 according to the first embodiment exhibits a form similar to that of the driving device 40' according to the second embodiment. It is particularly distinguished by the fact that it is devoid of squares C.

Whatever the considered embodiment, the drilling system includes a hollow core deviation measuring device 80 for measuring the deviation of the hollow core 32, 32' to identify a possible deviation between the displacement trajectory of the drilling device and the theoretical drilling trajectory. In this example, the theoretical drilling trajectory is a vertical trajectory, the displacement trajectory of said drilling device being the real trajectory of the drilling device.

The device 80 for measuring the deviation of the hollow core further includes a deviation sensor 82 that is disposed in the lower part of the hollow core.

The device 80 for measuring the deviation is further configured to determine a possible deviation direction DD of the drilling device with respect to the theoretical drilling trajectory, the deviation direction being considered in a horizontal plane Q that is defined by the frame of reference XY.

Furthermore, in accordance with the disclosure, the driving device 40, 40' presents an active state wherein the driving device 40, 40' is oriented and maintained with respect to the soil S, preferably being locked in rotation with respect to said soil S, in an angular correction position, such as to correct the displacement direction T of the drilling device 30, 30' according to a trajectory correcting direction DCT considered in the horizontal plane Q. The angular orientation and the locking in rotation with respect to the soil of the driving device 40, 40' are operated by the second device for setting into rotation 50.

As illustrated on FIG. 4B, the trajectory correcting direction DCT corresponds to the intersection between the slanted section P and a plane P' that is vertical and perpendicular to the section P. As explained hereinabove, the projection in the horizontal plane Q of this trajectory correcting direction shall be focused on.

In reference to FIG. 4B, it is understood that the mating of the driving device 40' (same for the driving device 40) results in that, in its active state, the driving device 40' tends, when it is stuck in the soil S, to move in translation according to the trajectory correction DCT illustrated on FIG. 4B, thus resulting in modifying the orientation of the linking element and the hollow core. It is also understood that, according to the angular correction position, considered in a horizontal plane, it is possible to modify the trajectory correcting direction DCT.

When said driving device is in its passive state, it is configured to rotate in the same direction and at the same speed as the hollow core, as mentioned previously, such that it does not modify the displacement trajectory of the drilling device.

Alternatively, when said driving device is in the passive state, the second device for setting into rotation is configured to make the driving device 40, 40' rotate in the opposite direction to the rotation direction of the hollow core 32'.

According to any one of these alternatives, the driving device 40, 40' in use of the drilling device does not modify the displacement trajectory of the hollow core, which is why it is said that the driving device is in its passive state.

The driving device 40, 40' is brought in its active state by locking its relative rotational movement with respect to the soil after having oriented it, thanks to the action of the second device for setting into rotation, in the angular position allowing to obtain the required trajectory correcting direction. While keeping on introducing the drilling device, the linking element and the hollow core swivel in a vertical plane passing by the trajectory correcting direction DCT, thus resulting in bringing the longitudinal axis L of the hollow core 32, 32' according to the theoretical drilling trajectory V.

The drilling system 10, 10' further includes a control device 100 that is configured to actuate the second device for setting into rotation 50 when a deviation is measured by the device 80, in order to bring the driving device 40, 40' in its active state by locking it in rotation with respect to the soil in an angular correction position determined in such a way that, considered in the horizontal plane Q, the trajectory correcting direction DCT associated to the angular correction position is opposed to the deviation direction.

In the alternative of the second embodiment, illustrated on FIG. 16, in which the second device for setting into rotation 50 is absent, the control device 100 is configured to bring the driving device in its active state by actuating the first device for setting into rotation after having actuated the coupling device 70.

The control device 100 further includes a computing device 102 for computing the angular correction position based on the deviation direction DD determined by the measuring device. The angular correction position is determined in such a way that the trajectory correcting direction DCT is opposed to the deviation direction. The control device drives the second device for setting into rotation in order to bring the driving device in the required angular correction position.

The deviation sensor 82 is configured to measure a deviation distance d of the hollow core 32, 32' with respect to a vertical direction. This distance is considered in a horizontal plane passing by the deviation sensor. Furthermore, the control device is configured to actuate the second device for setting into rotation when the ratio of the deviation distance d on the depth H reached by the drilling device is higher than or equal to a threshold that can depend on the reached depth. By way of example, this threshold can be 0.3%.

This shall be explained in further detail by means of FIGS. 5A to 8 which describe a method for drilling a well in the soil S according to a theoretical drilling trajectory V, in this instance vertical, using the drilling system according to the first embodiment of the disclosure.

On FIG. 5A, it has been illustrated the drilling device 30. During drilling, the longitudinal axis L of the hollow core being parallel to the theoretical drilling direction V, these are hence both vertical. The driving device 40 is in its passive state and the driving device is set into rotation by the second device for setting into rotation 50 in the opposite direction to the rotational direction of the hollow core 32.

The drilling device 10 is hence introduced into the soil while setting the hollow core 32 into rotation.

The possible deviation of the hollow core 32 is measured by means of the device 80 for measuring deviation of the hollow core in order to determine a deviation direction DD of the drilling device with respect to the theoretical drilling trajectory V.

On FIG. 5A, no deviation is detected. Also, considered in the horizontal plane Q, the driving device 40 is found in the centre of the frame of reference XY illustrated on FIG. 5B.

During drilling, as illustrated schematically on FIG. 6A, a deviation illustrated by a deviation distance d is measured. This deviation distance d, measured at depth H, for example 5m, being higher than a predetermined threshold, for example 2 cm, namely 0.4%, the control device drives the second device for setting into rotation such as to bring the driving device 40 in its active state by orienting it then locking it in rotation with respect to the soil S in an angular correction position determined, such that, considered in the horizontal plane Q, the trajectory correcting direction DCT associated to the angular correction position is opposed to the deviation direction DD. It is understood that the deviation illustrated on FIG. 6A is schematic and exaggerated to facilitate the comprehension of the disclosure.

Without departing from the scope of the present disclosure, other threshold values could be chosen by the skilled person depending on the required drilling precision.

In the example of FIG. 6B, in order to facilitate the comprehension, the deviation direction DD as well as the trajectory correcting direction DCT extend according to the axis X. However, these two directions could however not be parallel.

Finally, on FIG. 7A, it has been illustrated the position of the hollow core 32 after the latter is aligned again with the theoretical drilling trajectory V. The driving device is then brought in its passive state, for example by making it rotate in the opposite direction to the rotational direction of the hollow core 32. The drilling is hence pursued until a deviation higher than a predetermined threshold is measured again.

On FIG. 8, it has been illustrated a case where the deviation direction extends along a non parallel direction to axes X and Y. The operating principle is identical. The driving device is put in its active state by orienting it and locking it with respect to the soil, such that the trajectory correcting direction is opposed to the detected deviation direction. The trajectory correcting direction DCT is determined in such a way as to correct the verticality of the hollow core during the thrusting of the drilling device into the soil.

On FIGS. 9 to 12, it has been illustrated a method for drilling a well according to a second implementation embodiment, using the drilling system according to the second embodiment illustrated on FIGS. 4A and 4B.

Figure 11:
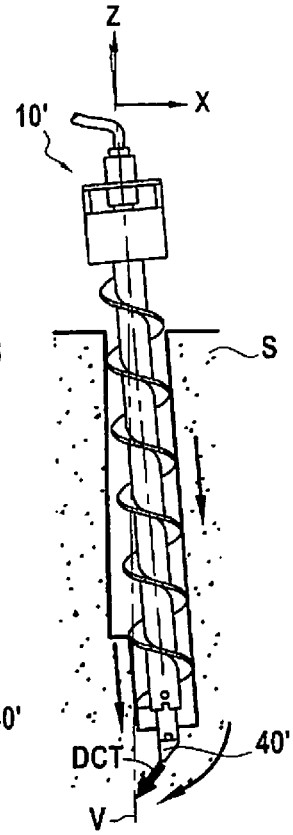
Figure 12:
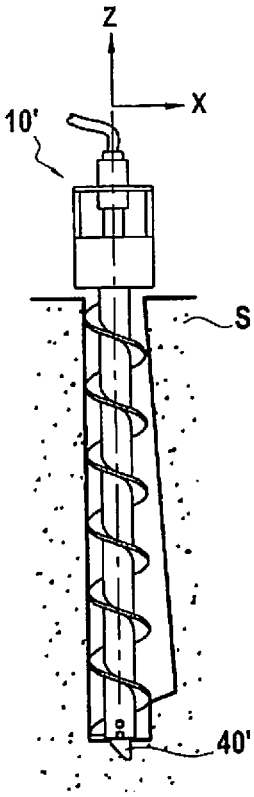

This second implementation embodiment differs from the first one by the fact that, when a deviation higher than a predetermined threshold is measured, the driving device 40' is brought in its active state and in its deployed position, illustrated on FIG. 11, for example by translation and vibratory driving. Then, the hollow core is displaced with respect to the soil, such that the displacement of the hollow core follows the displacement of the driving device, by which the verticality of the trajectory of the hollow core is corrected such as illustrated on FIG. 12.

The methods of drilling wells according to the first and second implementing embodiments, can advantageously be used as part of a method for making a column, such as a pile, a method wherein a fluid is injected into the well at the moment of the ascent of the drilling device in order to form the column in the soil.

Figure 14:
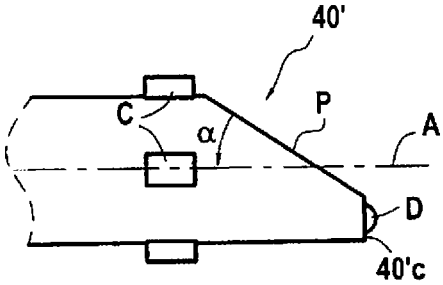
FIG. 14 is a side view of the driving device of FIG. 13.

Finally, on FIG. 14, it has been illustrated the deviation curves of the drilling tool according to the drilling depth. The curve GX illustrates the deviation according to the axis X whereas the curve GY illustrates the deviation according to the axis Y, and the curve GT illustrates the total deviation of the drilling device.

It is understood that the driving device is in its passive state up to a depth of around 8 meters, after which it is put in its active state up to around a depth of 12 meters, where it returns to its passive state. Hence, it is noted that the maximum deviation distance is about 3 cm for a depth ranging between 8 and 10 meters. In other words, during the drilling operation, the deviation expressed in percentage is at 0.375%, at maximum and hence lower than the critical limit of 0.5%.

The invention claimed is:

1. A system for drilling a well in a soil along a substantially vertical theoretical drilling trajectory, wherein the system includes:

a drilling device including a hollow core having a longitudinal axis, the hollow core being provided with a drilling tool;

a first device for rotating the hollow core and the drilling tool about the longitudinal axis;

a linking element extending inside the hollow core, the linking element including a tremie pipe which presents a lower part provided with at least one injecting hole, the tremie pipe being connected to a fluid supply source;

a driving device disposed at a lower end of the tremie pipe; the driving device presenting:

an active state in which the driving device is oriented and maintained with respect to the soil in an angular correction position, in such a way as to correct the displacement trajectory of the drilling device along a trajectory correcting direction considered in a horizontal plane, and a passive state in which the driving device does not modify the displacement trajectory of the drilling device;

a hollow core deviation measuring device for identifying a possible deviation between the displacement trajectory of the drilling device and the substantially vertical theoretical drilling trajectory and determining a deviation direction of the drilling device with respect to the substantially vertical theoretical drilling trajectory, said deviation direction being considered in the horizontal plane;

a control device configured for, when a deviation is measured in respect of the substantially vertical theoretical drilling trajectory, bringing the driving device in its active state in an angular correction position determined in such a way that, considered in the horizontal plane, the trajectory correcting direction associated with the angular correction position is opposite to the deviation direction;

wherein the driving device has a distal end comprising an inclined plane, which inclined plane engages with the soil to correct the displacement trajectory.

2. The drilling system according to claim 1, wherein the control device further includes a computing device for computing the angular correction position based on the deviation direction determined by the hollow core deviation measuring device.

3. The drilling system according to claim 1, wherein the driving device is configured to rotate in the same direction and at the same speed as the hollow core, when said driving device is in the passive state.

4. The drilling system according to claim 3, wherein the drilling device includes a coupling device to lock the rotation of the driving device with respect to the hollow core when said driving device is in the passive state.

5. The drilling system according to claim 1, further including a second device connected to the linking element, for rotating the linking element and the driving device about the longitudinal axis, wherein the linking element is capable of rotating with respect to the hollow core, and wherein the control device is configured to actuate the second device for setting into rotation when a deviation is measured so as to bring the driving device in its active state into said angular correction position.

6. The drilling system according to claim 5, wherein the second device is configured to make the driving device rotate in the opposite direction to the rotation direction of the hollow core, when said driving device is in the passive state.

7. The drilling system according to claim 1, wherein the driving device is moveable in translation with respect to the hollow core, wherein the drilling system further includes a displacement device for displacing in translation the driving device with respect to the hollow core along the longitudinal axis, in such a way that the driving device presents a deployed position and a retracted position.

8. The drilling system according to claim 7, wherein the displacement device is configured to displace the driving device with respect to the hollow core by jacking, jarring or vibratory driving.

9. The drilling system according to claim 7, wherein, in its active state, the driving device is in deployed position, whereas, in its passive state, the driving device is in retracted position.

10. The drilling system according to claim 7, wherein the driving device further presents an injecting position wherein the injecting hole is located underneath a lower end of the hollow core.

11. The drilling system according to claim 1, wherein the hollow core deviation measuring device includes an inclination sensor placed in the lower part of the hollow core.

12. The drilling system according to claim 1, wherein further including a member for measuring the depth reached by the drilling device, wherein the hollow core deviation measuring device is configured to measure a deviation distance of the hollow core with respect to a vertical direction, and wherein the control device is configured to bring the driving device in its active state when the ratio of the deviation distance to the depth reached by the drilling device is higher than or equal to a predetermined threshold.

13. The drilling system according to claim 1, wherein the drilling device is an auger.

14. The drilling system according to claim 1, wherein trajectory correcting direction is the direction corresponding to the intersection between the inclined plane and the vertical plane orthogonal to the inclined plane.

15. A method for making a column in a soil comprising a step of drilling a well in the soil along a substantially vertical theoretical drilling trajectory, the method comprising:

providing a drilling device including:

a hollow core having a longitudinal axis, the hollow core being provided with a drilling tool;

a first device for rotating the hollow core and the drilling tool about the longitudinal axis;

a linking element extending inside the hollow core, the linking element including a tremie pipe which presents a lower part provided with at least one injecting hole, the tremie pipe being connected to a concrete product source;

a driving device disposed at a lower end of the tremie pipe, the driving device presenting:

an active state in which the driving device is oriented and maintained with respect to the soil in an angular correction position, in such a way as to correct the displacement trajectory of the drilling device along a trajectory correcting direction considered in a horizontal plane, and a passive state in which the driving device does not modify the displacement trajectory of the drilling device;

a hollow core deviation measuring device for identifying a possible deviation between the displacement trajectory of the drilling device and the substantially vertical theoretical drilling trajectory and determining a deviation direction of the drilling device with respect to the substantially vertical theoretical drilling trajectory, said deviation direction being considered in the horizontal plane;

introducing the drilling device in the soil while setting the hollow core into rotation, the driving device being in its passive state;

measuring the deviation of the hollow core in order to determine a deviation direction of the drilling device with respect to the vertical theoretical drilling trajectory; and when a deviation higher than a predetermined threshold is measured, bringing the driving device in its active state by orienting it and maintaining it with respect to the soil in an angular correction position, determined such that, considered in a horizontal plane, the trajectory correcting direction associated with the angular correction position is opposite to the deviation direction; and injecting concrete product into the well through the at least one injecting hole during ascent of the drilling device in order to form the column in the soil.

16. The method according to claim 15, wherein the driving device is moveable in translation with respect to the hollow core, wherein the drilling system further includes a displacement device for displacing in translation the driving device with respect to the hollow core along the longitudinal axis, in such a way that the driving device presents a deployed position and a retracted position, wherein said drilling method comprises:

when a deviation is measured:

bringing the driving device in its active state by orienting and maintaining it with respect to the soil, the driving device in an angular correction position determined, such that, considered in a horizontal plane, the trajectory correcting direction associated to the angular correction position is opposite to the deviation direction;

bringing the driving device in its deployed position; and displacing the hollow core with respect to the soil such that the displacement of the hollow core follows the displacement of the driving device.

17. The method according to claim 15, further comprising:

measuring the depth reached by the drilling device;

measuring a deviation distance of the hollow core with respect to a vertical direction; and bringing the driving device in its active state when the ratio of the deviation distance to the depth reached by the drilling device is higher than or equal to a predetermined threshold.

18. A system for drilling a well in a soil according to a substantially vertical theoretical drilling trajectory, wherein the system includes:

a drilling device including a hollow core having a longitudinal axis, the hollow core being provided with a drilling tool;

a first device for rotating the hollow core and the drilling tool, around the longitudinal axis;

a linking element extending inside the hollow core, the linking element including a tremie pipe which presents a lower part provided with at least one injecting hole, the tremie pipe being connected to a fluid supply source;

a driving device disposed at a lower end of the tremie pipe; the driving device presenting:

an active state in which the driving device is oriented and maintained with respect to the soil in an angular correction position, in such a way as to correct the displacement trajectory of the drilling device along a trajectory correcting direction considered in a horizontal plane, and a passive state in which the driving device does not modify the displacement trajectory of the drilling device;

a hollow core deviation measuring device for identifying a possible deviation between the displacement trajectory of the drilling device and the theoretical drilling trajectory and determining a deviation direction of the drilling device with respect to the theoretical drilling trajectory, said deviation direction being considered in the horizontal plane;

a control device configured for, when a deviation is measured, bringing the driving device in its active state in an angular correction position determined in such a way that, considered in the horizontal plane, the trajectory correcting direction associated with the angular correction position is opposite to the deviation direction; and a member for measuring the depth reached by the drilling device, wherein the hollow core deviation measuring device is configured to measure a deviation distance of the hollow core with respect to a vertical direction, and wherein the control device is configured to bring the driving device in its active state when the ratio of the deviation distance to the depth reached by the drilling device is higher than or equal to a predetermined threshold.

19. A system for drilling a well in a soil according to a substantially vertical theoretical drilling trajectory, wherein the system includes:

a drilling device including a hollow core having a longitudinal axis, the hollow core being provided with a drilling tool;

a first device for rotating the hollow core and the drilling tool, around the longitudinal axis;

a linking element extending inside the hollow core, the linking element including a tremie pipe which presents a lower part provided with at least one injecting hole, the tremie pipe being connected to a fluid supply source;

a driving device disposed at a lower end of the tremie pipe; the driving device being moveable in translation with respect to the hollow core, wherein the drilling system further includes a displacement device for displacing in translation the driving device with respect to the hollow core along the longitudinal axis between a first deployed position and a retracted position, wherein said driving device presents:

an active state in which the driving device is in the first deployed position and is oriented and maintained with respect to the soil in an angular correction position, in such a way as to correct the displacement trajectory of the drilling device along a trajectory correcting direction considered in a horizontal plane, and a passive state in which the driving device is in the retracted position and does not modify the displacement trajectory of the drilling device;

a hollow core deviation measuring device for identifying a possible deviation between the displacement trajectory of the drilling device and the theoretical drilling trajectory and determining a deviation direction of the drilling device with respect to the theoretical drilling trajectory, said deviation direction being considered in the horizontal plane;

a control device configured for, when a deviation is measured, bringing the driving device in its active state in an angular correction position determined in such a way that, considered in the horizontal plane, the trajectory correcting direction associated with the angular correction position is opposite to the deviation direction, wherein, the injecting hole is located above a lower end of the hollow core when the driving device is in the active and passive states.

20. The drilling system according to claim 19, wherein the driving device further presents an injecting position corresponding to a second deployed position of the driving device in which the injecting hole is located underneath the lower end of the hollow core.

21. A system for making a substantially vertical column in a soil along a substantially vertical theoretical drilling trajectory, wherein the system includes:

a drilling device including a hollow core having a longitudinal axis, the hollow core being provided with a drilling tool;

a first device for rotating the hollow core and the drilling tool about the longitudinal axis;

a linking element extending inside the hollow core, the linking element including a tremie pipe which presents a lower part provided with at least one concrete product injecting hole, the tremie pipe being connected to a concrete product supply source;

a driving device disposed at a lower end of the tremie pipe; the driving device presenting:

an active state in which the driving device is oriented and maintained with respect to the soil in an angular correction position, in such a way as to correct the displacement trajectory of the drilling device along a trajectory correcting direction considered in a horizontal plane, and a passive state in which the driving device does not modify the displacement trajectory of the drilling device;

a hollow core deviation measuring device for identifying a possible deviation between the displacement trajectory of the drilling device and the substantially vertical theoretical drilling trajectory and determining a deviation direction of the drilling device with respect to the substantially vertical theoretical drilling trajectory, said deviation direction being considered in the horizontal plane;

a control device configured for, when a deviation is measured in respect of the substantially vertical theoretical drilling trajectory, bringing the driving device in its active state in an angular correction position determined in such a way that, considered in the horizontal plane, the trajectory correcting direction associated with the angular correction position is opposite to the deviation direction.

* * * * *